US006602364B1

(12) United States Patent
Tundal et al.

(10) Patent No.: US 6,602,364 B1
(45) Date of Patent: Aug. 5, 2003

(54) ALUMINIUM ALLOY CONTAINING MAGNESIUM AND SILICON

(75) Inventors: Ulf Tundal, Sunndalsora (NO); Reiso Oddvin, Sunndalsora (NO)

(73) Assignee: Norsk Hydro A.S., Oslo (NO)

( * ) Notice: Subject to any disclaimer, the term of this patent is extended or adjusted under 35 U.S.C. 154(b) by 0 days.

(21) Appl. No.: 09/913,086

(22) PCT Filed: Feb. 12, 1999

(86) PCT No.: PCT/EP99/00939

§ 371 (c)(1),
(2), (4) Date: Jun. 6, 2002

(87) PCT Pub. No.: WO00/47789

PCT Pub. Date: Aug. 17, 2000

(51) Int. Cl.[7] ..... C22F 1/05
(52) U.S. Cl. ..... 148/690; 148/694; 148/702
(58) Field of Search ..... 148/694, 690, 148/702; C22F 1/05

(56) References Cited

U.S. PATENT DOCUMENTS 6,364,969 B1 * 4/2002 Couper ..... 148/415
6,440,359 B1 * 8/2002 Parson et al. ..... 420/544

FOREIGN PATENT DOCUMENTS

WO WO 9506759 A1 * 3/1995 ..... C22C/21/02

* cited by examiner

*Primary Examiner*—George Wyszomierski
*Assistant Examiner*—Janelle Combs Morillo
(74) *Attorney, Agent, or Firm*—Gary M. Hartman; Domenica N.S. Hartman; Hartman & Hartman

(57) ABSTRACT

An aluminum alloy and a process for treating the aluminum alloy. The alloy contains 0.5 to 2.5% by weight of an alloying mixture of magnesium and silicon, in which the molar ratio of Mg/Si is 0.70 to 1.25, the alloy optionally containing an additional amount of silicon up to about ⅓ of any iron, manganese and chromium in the alloy, as expressed by weight percent, the balance of the alloy being aluminum, optional alloying elements and unavoidable impurities. The process entails an ageing technique that includes a first stage in which an extrusion of the aluminum alloy is heated at a rate above 100° C./hour to 100–170° C., a second stage in which the extrusion is heated at a rate of 5 to 50° C./hour to a final hold temperature, wherein the total ageing operation is performed in 3 to 24 hours.

20 Claims, 1 Drawing Sheet

ALUMINIUM ALLOY CONTAINING MAGNESIUM AND SILICON

This application claims benefit of International Application No. PCT/EP99/00939, filed Feb. 12, 1999.

BACKGROUND OF THE INVENTION (1) Field of the Invention

The invention relates to a process of treating an aluminum alloy consisting of 0,5–2,5% by weight of an alloying mixture of magnesium and silicon, the molar ration of Mg/Si lying between 0,70 and 1,25, an additional amount of Si equal to ⅓ of the amount of Fe, Mn and Cr in the alloy, as expressed by % by weight, other alloying elements and unavoidable impurities, and the rest being made up of aluminium, which alloy after cooling has been submitted to homogenising, preheating before extrusion and ageing, which ageing takes place after extrusion as a dual step ageing operation to a final hold temperature between 160° C. and 220° C.

(2) Description of the Related Art

A process for ageing aluminum alloys containing magnesium and silicon (Al—Mg—Si) is described in WO 95.06769. According to this publication the ageing is performed at a temperature between 150 and 200° C., and the rate of heating is between 10–100° C./hour preferably 10–70° C./hour. As an alternative to this, a two-step heating schedule is proposed, wherein a hold temperature in the range of 80–140° C. is suggested in order to obtain an overall heating rate within the above specified range.

It is generally known that higher total amounts of Mg and Si will have a positive effect on the mechanical properties of the final product, whereas this has a negative effect on the extrudability of the aluminium alloy. It has previously been anticipated that the hardening phase in the Al—Mg—Si alloys had a composition close to $Mg_2Si$. However, it was also known that an excess of Si produced higher mechanical properties.

Later experiments have shown that the precipitation sequence is quite complex and that except for the equilibrium phase, the phases involved do not have the stoichiometric ratio $Mg_2Si$. In a publication of S. J. Andersen, et. al, Acta mater, Vol. 46 No. 9 p. 3283–3298 of 1998 it has been suggested that one of the hardening phases in Al—Mg—Si alloys has a composition close to $Mg_5Si_6$.

BRIEF SUMMARY OF THE INVENTION

The present invention provides an aluminum alloy and a process for treating the aluminum alloy which results in the alloy having better mechanical properties and better extrudability as compared to traditional aluminium alloys. In particular, the alloy contains 0.5 to 2.5% by weight of an alloying mixture of magnesium and silicon, in which the molar ratio of Mg/Si is 0.70 to 1.25, the alloy optionally containing an additional amount of silicon up to about ⅓ of any iron, manganese and chromium in the alloy, as expressed by weight percent, the balance of the alloy being aluminum, optional alloying elements and unavoidable impurities. The process for treating this alloy entails an ageing technique that includes a first stage in which an extrusion of the aluminum alloy is heated with a heating rate above 100° C./hour to a temperature between 100–170° C., a second stage in which the extrusion is heated with a heating rate between 5 and 50° C./hour to a final hold temperature, and in that the total ageing cycle is performed in a time of 3 to 24 hours.

DETAILED DESCRIPTION OF THE INVENTION

Figure 1:
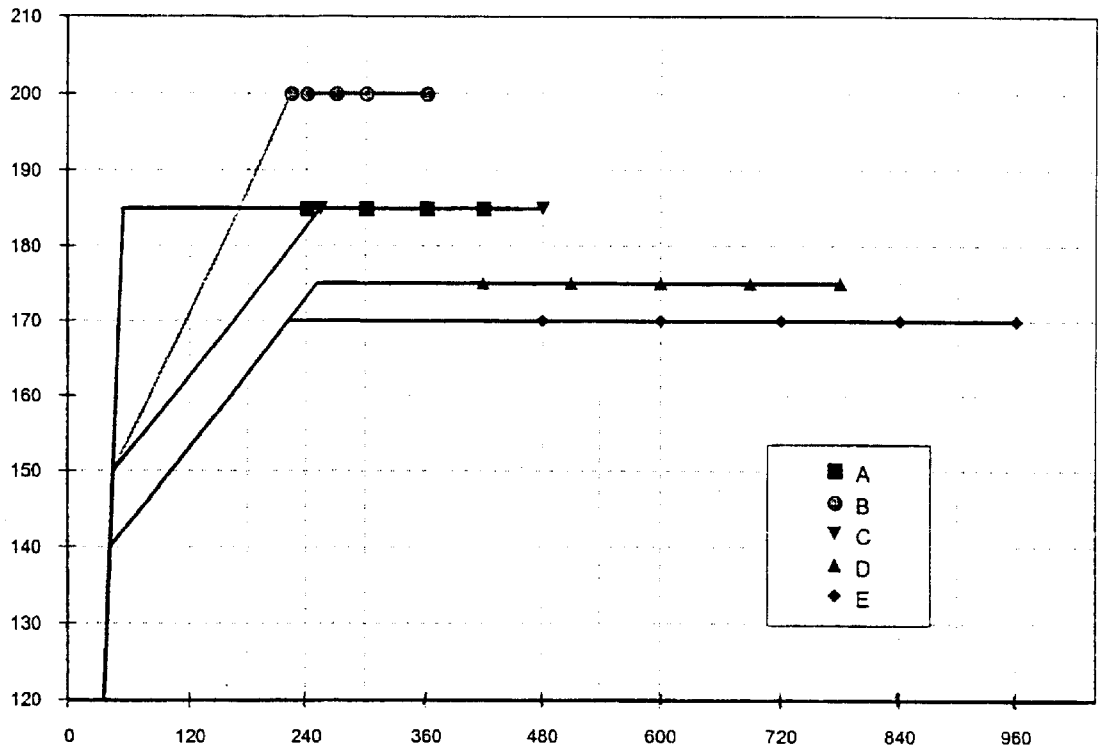
FIG. 1 is a graph showing five different ageing cycles evaluated with different Al—Mg—Si alloys of this invention.

The optimum Mg/Si ratio is the one where all the available Mg and Si is transformed into $Mg_5Si_6$ phases. This combination of Mg and Si gives the highest mechanical strength with the minimum use of the alloying elements Mg and Si. It has been found that the maximum extrusion speed is almost independent of the Mg/Si ratio. Therefore, with the optimum Mg/Si ratio the sum of Mg and Si is minimised for a certain strength requirement, and this alloy will thus also provide the best extrudability. By using the composition according to the invention combined with the dual rate ageing procedure according to the invention, it has been obtained that the strength and extrudability are maximised with a minimum total ageing time.

In addition to the $Mg_5Si_6$ phase there is also another hardening phase which contains more Mg than the $Mg_5Si_6$ phase. However, this phase is not as effective, and does not contribute so much to the mechanical strength as the $Mg_5Si_6$ phase. On the Si rich side of the $Mg_5Si_6$ phase there is most probably no hardening phase, and lower Mg/Si ratios than ⅚ will not be beneficial.

The positive effect on the mechanical strength of the dual rate ageing procedure can be explained by the fact that a prolonged time at low temperature generally enhances the formation of a higher density of precipitates of Mg—Si. If the entire ageing operation is performed at such temperature, the total ageing time will be beyond practical limits and the throughput in the ageing ovens will be too low. By a slow increase of the temperature to the final ageing temperature, the high number of precipitates nucleated at the low temperature will continue to grow. The result will be a high number of precipitates and mechanical strength values associated with low temperature ageing but with a considerably shorter total ageing time.

A two step ageing also give improvements in the mechanical strength, but with a fast heating from the first hold temperature to the second hold temperature there is substantial chance of reversion of the smallest precipitates, with a lower number of hardening precipitates and thus a lower mechanical strength as a result. Another benefit of the dual rate ageing procedure as compared to normal ageing and also two step ageing, is that a slow heating rate will ensure a better temperature distribution in the load. The temperature history of the extrusions in the load will be almost independent of the size of the load, the packing density and the wall thickness' of the extrusions. The result will be more consistent mechanical properties than with other types of ageing procedures.

As compared to the ageing procedure described in WO 95.06759 where the slow heating rate is started from the room temperature, the dual rate ageing procedure will reduce the total ageing time by applying a fast heating rate from room temperature to temperatures between 100 and 170° C. The resulting strength will be almost equally good when the slow heating is started at an intermediate temperature as if the slow heating is started at room temperature.

Dependent upon the class of strength envisaged different compositions are possible within the general scope of the invention.

So it is possible to have an aluminium alloy with a tensile strength in the class F19–F22, the amount of alloying mixture of magnesium of silicon being between 0,60 and 1,10% by weight. For an alloy with a tensile strength in the class F25–F27, it is possible to use an aluminium alloy containing between 0,80 and 1,40 by weight of an alloying mixture of magnesium and silicon and for an alloy with a tensile strength in the class F29–F31, it is possible to use an aluminium alloy containing between 1,10 and 1,80% by weight of the alloying mixture of magnesium and silicon.

Preferably and according to the invention a tensile strength in the class F19 (185–220 MPa) is obtained by an alloy containing between 0,60 and 0,80% by weight of the alloying mixture, a tensile strength in the class F22 (215–250 MPa) by an alloy containing between 0,70 and 0,90% by weight of the alloying mixture, a tensile strength in the class F25 (245–270 MPa) by an alloy containing between 0,85 and 1,15% by weight of the alloying mixture, a tensile strength in the class F27 (265–290 MPa) by an alloy containing between 0,95 and 1,25% by weight of the alloying mixture, a tensile strength in the class F29 (285–310 MPa) by an alloy containing between 1,10 and 1,40% by weight of the alloying mixture, and a tensile strength in the class F31 (305–330 MPa) by an alloy containing between 1,20 and 1,55% by weight of the alloying mixture.

With additions of Cu, which as a rule of thumb increases the mechanical strength by 10 MPa per 0.10 wt. % Cu, the total amount of Mg and Si can be reduced and still match a strength class higher than the Mg and Si additions alone would give.

For the reason described above it is preferred that the molar ratio Mg/Si lies between 0.75 and 1.25 and more preferably between 0.8 and 1.0.

In a preferred embodiment of the invention the final ageing temperature is at least 165° C. and more preferably the ageing temperature is at most 205° C. When using these preferred temperatures it has been found that the mechanical strength is maximised while the total ageing time remains within reasonable limits.

In order to reduce the total ageing time in the dual rate ageing operation it is preferred to perform the first heating stage at the highest possible heating rate available, while as a rule is dependent upon the equipment available. Therefore, it is preferred to use in the first heating stage a heating rate of at least 100° C./hour.

In the second heating stage the heating rate must be optimised in view of the total efficiency in time and the ultimate quality of the alloy. For that reason the second heating rate is preferably at least 7° C./hour and at most 30° C./hour. At lower heating rates than 7° C./hour the total ageing time will be long with a low throughput in the ageing ovens as a result, and at higher heating rates than 30° C./hour the mechanical properties will be lower than ideal.

Preferably, the first heating stage will end up at 130–160° C. and at these temperatures there is a sufficient precipitation of the $Mg_5Si_6$ phase to obtain a high mechanical strength of the alloy. A lower end temperature of the first stage will generally lead to an increased total ageing time. Preferably the total ageing time is at most 12 hours.

In order to have an extruded product with almost all the Mg and Si in solid solution before the ageing operation, it is important to control the parameters during extrusion and cooling after extrusion. With the right parameters this can be obtained by normal preheating. However, by using a so-called overheating process described in EP 0302623, which is a preheating operation where the alloy is heated to a temperature between 510 and 560° C. during the preheating operation before extrusion, after which the billets are cooled to normal extrusion temperatures, this will ensure that all the Mg and Si added to the alloy are dissolved. By proper cooling of the extruded product the Mg and Si are maintained solved and available for forming hardening precipitates during the ageing operation.

For low alloy compositions the solutionising of Mg and Si can be obtained during the extrusion operation without overheating if the extrusion parameters are correct. However, with higher alloy compositions normal preheating conditions are not always enough to get all Mg and Si into solid solution. In such cases overheating will make the extrusion process more robust and always ensure that the all the Mg and Si are in solid solution when the profile comes out of the press.

Other characteristics and advantages will be clear from the following description of a number of tests done with alloys according to the invention.

EXAMPLE 1

Eight different alloys with the composition given in Table 1 were cast as Ø95 mm billets with standard casting conditions for 6060 alloys. The billets were homogenised with a heating rate of approximately 250° C./hour, the holding period was 2 hours and 15 minutes at 575° C., and the cooling rate after homogenisation was approximately 350° C./hour. The logs were finally cut into 200 mm long billets.

TABLE 1

| Alloy | Si | Mg | Fe | Total Si + Mg |
|---|---|---|---|---|
| 1 | 0,34 | 0,40 | 0,20 | 0,74 |
| 2 | 0,37 | 0,36 | 0,19 | 0,73 |
| 3 | 0,43 | 0,31 | 0,19 | 0,74 |
| 4 | 0,48 | 0,25 | 0,20 | 0,73 |
| 5 | 0,37 | 0,50 | 0,18 | 0,87 |
| 6 | 0,41 | 0,47 | 0,19 | 0,88 |
| 7 | 0,47 | 0,41 | 0,20 | 0,88 |
| 8 | 0,51 | 0,36 | 0,19 | 0,87 |

The extrusion trial was performed in an 800 ton press equipped with a Ø100 mm container, and an induction furnace to heat the billets before extrusion.

The die used for the extrudability experiments produced a cylindrical rod with a diameter of 7 mm with two ribs of 0.5 mm width and 1 mm height, located 180° apart.

In order to get good measurements of the mechanical properties of the profiles, a separate trial was run with a die which gave a 2*25 $mm^2$ bar. The billets were preheated to approximately 500° C. before extrusion. After extrusion the profiles were cooled in still air giving a cooling time of approximately 2 min down to temperatures below 250° C. After extrusion the profiles were stretched 0.5%. The storage time at room temperature were controlled before ageing. Mechanical properties were obtained by means of tensile testing.

The complete results of the extrudability tests for these alloys are shown in table 2 and 3.

TABLE 2

Extrusion tests for alloys 1–4

| Alloy no. | Ram Speed mm/sec. | Billet Temperature ° C. | Remarks |
|---|---|---|---|
| 1 | 16 | 502 | OK |
| 1 | 17 | 503 | OK |
| 1 | 18 | 502 | Tearing |
| 1 | 17 | 499 | OK |
| 1 | 19 | 475 | OK |
| 1 | 20 | 473 | OK |
| 1 | 21 | 470 | Tearing |
| 2 | 16 | 504 | OK |
| 2 | 17 | 503 | Small Tearing |
| 2 | 18 | 500 | Tearing |

TABLE 2-continued

| Extrusion tests for alloys 1–4 | | | |
|---|---|---|---|
| Alloy no. | Ram Speed mm/sec. | Billet Temperature ° C. | Remarks |
| 2 | 20 | 474 | OK |
| 2 | 19 | 473 | OK |
| 2 | 18 | 470 | OK |
| 2 | 21 | 469 | Small Tearing |
| 3 | 17 | 503 | Tearing |
| 3 | 16 | 505 | OK |
| 3 | 15 | 504 | OK |
| 3 | 19 | 477 | OK |
| 3 | 18 | 477 | OK |
| 3 | 20 | 472 | OK |
| 3 | 21 | 470 | Tearing |
| 4 | 17 | 504 | OK |
| 4 | 18 | 505 | Tearing |
| 4 | 16 | 502 | OK |
| 4 | 19 | 477 | OK |
| 4 | 20 | 478 | OK |
| 4 | 20 | 480 | Small Tearing |
| 4 | 21 | 474 | Tearing |

For alloys 1–4 which have approximately the same sum of Mg and Si but different Mg/Si maximum extrusion speed before tearing is approximately the same at billet temperatures.

TABLE 3

| Extrusion tests for alloys 5–8 | | | |
|---|---|---|---|
| Alloy no. | Ram Speed mm/sec. | Billet Temperature ° C. | Remarks |
| 5 | 14 | 495 | OK |
| 5 | 14,5 | 500 | Tearing |
| 5 | 15 | 500 | Tearing |
| 5 | 14 | 500 | Small Tearing |
| 5 | 17 | 476 | Tearing |
| 5 | 16,5 | 475 | OK |
| 5 | 16,8 | 476 | Small Tearing |
| 5 | 17 | 475 | Tearing |
| 6 | 14 | 501 | Small Tearing |
| 6 | 13,5 | 503 | OK |
| 6 | 14 | 505 | Tearing |
| 6 | 14,5 | 500 | Tearing |
| 6 | 17 | 473 | Tearing |
| 6 | 16,8 | 473 | Tearing |
| 6 | 16,5 | 473 | OK |
| 6 | 16,3 | 473 | OK |
| 7 | 14 | 504 | Tearing |
| 7 | 13,5 | 506 | Small Tearing |
| 7 | 13,5 | 500 | OK |
| 7 | 13,8 | 503 | Small Tearing |
| 7 | 17 | 472 | Small Tearing |
| 7 | 16,8 | 476 | Tearing |
| 7 | 16,6 | 473 | OK |
| 7 | 17 | 475 | Tearing |
| 8 | 13,5 | 505 | OK |
| 8 | 13,8 | 505 | Tearing |
| 8 | 13,6 | 504 | OK |
| 8 | 14 | 505 | Tearing |
| 8 | 17 | 473 | Small Tearing |
| 8 | 17,2 | 474 | Small Tearing |
| 8 | 17,5 | 471 | Tearing |
| 8 | 16,8 | 473 | OK |

For alloys 5–8 which have approximately the same sum of Mg and Si but different Mg/Si ratios, the maximum extrusion speed before tearing is approximately the same at comparable billet temperatures. However, by comparing alloys 1–4 which have a lower sum of Mg and Si with alloys 5–8, the maximum extrusion speed is generally higher for alloys 1–4.

The mechanical properties of the different alloy aged at different ageing cycles are shown in tables 4–11.

As an explanation to these tables, reference is made to FIG. 1 in which different ageing cycles are shown graphically and identified by a letter. In FIG. 1 there is shown the total ageing time on the x-axis, and the temperature used is along the y-axis.

Furthermore the different columns have the following meaning:

Total time=Total ageing time for the ageing cycle.

Rm=ultimate tensile strength;

$R_{PO2}$=yield strength;

AB=elongation to fracture;

Au=uniform elongation.

All these data has been obtained by means of standard tensile testing and the numbers shown are the average of two parallel samples of the extruded profile.

TABLE 4

| Alloy 1–0.40 Mg + 0.34 Si | | | | | |
|---|---|---|---|---|---|
| | Total Time [hrs] | Rm | Rp02 | AB | Au |
| A | 3 | 143,6 | 74,0 | 16,8 | 8,1 |
| A | 4 | 160,6 | 122,3 | 12,9 | 6,9 |
| A | 5 | 170,0 | 137,2 | 12,6 | 5,6 |
| A | 6 | 178,1 | 144,5 | 12,3 | 5,6 |
| A | 7 | 180,3 | 150,3 | 12,3 | 5,2 |
| B | 3,5 | 166,8 | 125,6 | 12,9 | 6,6 |
| B | 4 | 173,9 | 135,7 | 11,9 | 6,1 |
| B | 4,5 | 181,1 | 146,7 | 12,0 | 5,4 |
| B | 5 | 188,3 | 160,8 | 12,2 | 5,1 |
| B | 6 | 196,0 | 170,3 | 11,9 | 4,7 |
| C | 4 | 156,9 | 113,8 | 12,6 | 7,5 |
| C | 5 | 171,9 | 134,7 | 13,2 | 6,9 |
| C | 6 | 189,4 | 154,9 | 12,0 | 6,2 |
| C | 7 | 195,0 | 168,6 | 11,9 | 5,8 |
| C | 8 | 199,2 | 172,4 | 12,3 | 5,4 |
| D | 7 | 185,1 | 140,8 | 12,9 | 6,4 |
| D | 8,5 | 196,5 | 159,0 | 13,0 | 6,2 |
| D | 10 | 201,8 | 171,6 | 13,3 | 6,0 |
| D | 11,5 | 206,4 | 177,5 | 12,9 | 6,1 |
| D | 13 | 211,7 | 184,0 | 12,5 | 5,4 |
| E | 8 | 190,5 | 152,9 | 12,8 | 6,5 |
| E | 10 | 200,3 | 168,3 | 12,1 | 6,0 |
| E | 12 | 207,1 | 176,7 | 12,3 | 6,0 |
| E | 14 | 211,2 | 185,3 | 12,4 | 5,9 |
| E | 16 | 213,9 | 188,8 | 12,3 | 6,6 |

TABLE 5

| Alloy 2–0.36 Mg + 0.37 Si | | | | | |
|---|---|---|---|---|---|
| | Total Time [hrs] | Rm | Rp02 | AB | Au |
| A | 3 | 150,1 | 105,7 | 13,4 | 7,5 |
| A | 4 | 164,4 | 126,1 | 13,6 | 6,6 |
| A | 5 | 174,5 | 139,2 | 12,9 | 6,1 |
| A | 6 | 183,1 | 154,4 | 12,4 | 4,9 |
| A | 7 | 185,4 | 157,8 | 12,0 | 5,4 |
| B | 3,5 | 175,0 | 135,0 | 12,3 | 6,3 |
| B | 4 | 181,7 | 146,6 | 12,1 | 6,0 |
| B | 4,5 | 190,7 | 158,9 | 11,7 | 5,5 |
| B | 5 | 195,5 | 169,9 | 12,5 | 5,2 |
| B | 6 | 202,0 | 175,7 | 12,3 | 5,4 |
| C | 4 | 161,3 | 114,1 | 14,0 | 7,2 |
| C | 5 | 185,7 | 145,9 | 12,1 | 6,1 |
| C | 6 | 197,4 | 167,6 | 11,6 | 5,9 |
| C | 7 | 203,9 | 176,0 | 12,6 | 6,0 |
| C | 8 | 205,3 | 178,9 | 12,0 | 5,5 |
| D | 7 | 195,1 | 151,2 | 12,6 | 6,6 |
| D | 8,5 | 208,9 | 180,4 | 12,5 | 5,9 |
| D | 10 | 210,4 | 181,1 | 12,8 | 6,3 |
| D | 11,5 | 215,2 | 187,4 | 13,7 | 6,1 |

TABLE 5-continued

| | Alloy 2–0.36 Mg + 0.37 Si | | | | |
|---|---|---|---|---|---|
| | Total Time [hrs] | Rm | Rp02 | AB | Au |
| D | 13 | 219,4 | 189,3 | 12,4 | 5,8 |
| E | 8 | 195,6 | 158,0 | 12,9 | 6,7 |
| E | 10 | 205,9 | 176,2 | 13,1 | 6,0 |
| E | 12 | 214,8 | 185,3 | 12,1 | 5,8 |
| E | 14 | 216,9 | 192,5 | 12,3 | 5,4 |
| E | 16 | 221,5 | 196,9 | 12,1 | 5,4 |

TABLE 6

| | Alloy 3–0.31 Mg + 0.43 Si | | | | |
|---|---|---|---|---|---|
| | Total Time [hrs] | Rm | Rp02 | AB | Au |
| A | 3 | 154,3 | 111,0 | 15,0 | 8,2 |
| A | 4 | 172,6 | 138,0 | 13,0 | 6,5 |
| A | 5 | 180,6 | 148,9 | 13,0 | 5,7 |
| A | 6 | 189,7 | 160,0 | 12,2 | 5,5 |
| A | 7 | 192,5 | 164,7 | 12,6 | 5,3 |
| B | 3,5 | 187,4 | 148,9 | 12,3 | 6,3 |
| B | 4 | 193,0 | 160,3 | 11,5 | 5,9 |
| B | 4,5 | 197,7 | 168,3 | 11,6 | 5,1 |
| B | 5 | 203,2 | 177,1 | 12,4 | 5,5 |
| B | 6 | 205,1 | 180,6 | 11,7 | 5,4 |
| C | 4 | 170,1 | 127,4 | 14,3 | 7,5 |
| C | 5 | 193,3 | 158,2 | 13,4 | 6,2 |
| C | 6 | 207,3 | 179,2 | 12,6 | 6,4 |
| C | 7 | 212,2 | 185,3 | 12,9 | 5,7 |
| C | 8 | 212,0 | 188,7 | 12,3 | 5,6 |
| D | 7 | 205,6 | 157,5 | 13,2 | 6,7 |
| D | 8,5 | 218,7 | 190,4 | 12,7 | 6,0 |
| D | 10 | 219,6 | 191,1 | 12,9 | 6,7 |
| D | 11,5 | 222,5 | 197,5 | 13,1 | 5,9 |
| D | 13 | 226,0 | 195,7 | 12,2 | 6,1 |
| E | 8 | 216,6 | 183,5 | 12,6 | 6,8 |
| E | 10 | 217,2 | 190,4 | 12,6 | 6,9 |
| E | 12 | 221,6 | 193,9 | 12,4 | 6,6 |
| E | 14 | 225,7 | 200,6 | 12,4 | 6,0 |
| E | 16 | 224,4 | 197,8 | 12,1 | 5,9 |

TABLE 7

| | Alloy 4–0.25 Mg + 0.48 Si | | | | |
|---|---|---|---|---|---|
| | Total Time [hrs] | Rm | Rp02 | AB | Au |
| A | 3 | 140,2 | 98,3 | 14,5 | 8,6 |
| A | 4 | 152,8 | 114,6 | 14,5 | 7,2 |
| A | 5 | 166,2 | 134,9 | 12,7 | 5,9 |
| A | 6 | 173,5 | 141,7 | 12,8 | 5,7 |
| A | 7 | 178,1 | 147,6 | 12,3 | 5,2 |
| B | 3,5 | 165,1 | 123,5 | 13,3 | 6,4 |
| B | 4 | 172,2 | 136,4 | 11,8 | 5,7 |
| B | 4,5 | 180,7 | 150,2 | 12,1 | 5,2 |
| B | 5 | 187,2 | 159,5 | 12,0 | 5,6 |
| B | 6 | 192,8 | 164,6 | 12,1 | 5,0 |
| C | 4 | 153,9 | 108,6 | 13,6 | 7,7 |
| C | 5 | 177,2 | 141,8 | 12,0 | 6,5 |
| C | 6 | 190,2 | 159,7 | 11,9 | 5,9 |
| C | 7 | 197,3 | 168,6 | 12,3 | 6,1 |
| C | 8 | 197,9 | 170,6 | 12,5 | 5,6 |
| D | 7 | 189,5 | 145,6 | 12,3 | 6,4 |
| D | 8,5 | 202,2 | 171,6 | 12,6 | 6,1 |
| D | 10 | 207,9 | 178,8 | 12,9 | 6,0 |
| D | 11,5 | 210,7 | 180,9 | 12,7 | 5,6 |
| D | 13 | 213,3 | 177,7 | 12,4 | 6,0 |
| E | 8 | 195,1 | 161,5 | 12,8 | 5,9 |
| E | 10 | 205,2 | 174,1 | 12,5 | 6,4 |

TABLE 7-continued

| | Alloy 4–0.25 Mg + 0.48 Si | | | | |
|---|---|---|---|---|---|
| | Total Time [hrs] | Rm | Rp02 | AB | Au |
| E | 12 | 208,3 | 177,3 | 12,8 | 5,6 |
| E | 14 | 211,6 | 185,9 | 12,5 | 6,3 |
| E | 16 | 217,6 | 190,0 | 12,4 | 6,2 |

TABLE 8

| | Alloy 5–0.50 Mg + 0.37 Si | | | | |
|---|---|---|---|---|---|
| | Total Time [hrs] | Rm | Rp02 | AB | Au |
| A | 3 | 180,6 | 138,8 | 13,9 | 7,1 |
| A | 4 | 194,2 | 155,9 | 13,2 | 6,6 |
| A | 5 | 203,3 | 176,5 | 12,8 | 5,6 |
| A | 6 | 210,0 | 183,6 | 12,2 | 5,7 |
| A | 7 | 211,7 | 185,9 | 12,1 | 5,8 |
| B | 3,5 | 202,4 | 161,7 | 12,8 | 6,6 |
| B | 4 | 204,2 | 170,4 | 12,5 | 6,1 |
| B | 4,5 | 217,4 | 186,7 | 12,1 | 5,6 |
| B | 5 | 218,9 | 191,5 | 12,1 | 5,5 |
| B | 6 | 222,4 | 198,2 | 12,3 | 6,0 |
| C | 4 | 188,6 | 136,4 | 15,1 | 10,0 |
| C | 5 | 206,2 | 171,2 | 13,4 | 7,1 |
| C | 6 | 219,2 | 191,2 | 12,9 | 6,2 |
| C | 7 | 221,4 | 194,4 | 12,1 | 6,1 |
| C | 8 | 224,4 | 202,8 | 11,8 | 6,0 |
| D | 7 | 213,2 | 161,5 | 14,0 | 7,5 |
| D | 8,5 | 221,5 | 186,1 | 12,6 | 6,7 |
| D | 10 | 229,9 | 200,8 | 12,1 | 5,7 |
| D | 11,5 | 228,2 | 200,0 | 12,3 | 6,3 |
| D | 13 | 233,2 | 198,1 | 11,4 | 6,2 |
| E | 8 | 221,3 | 187,7 | 13,5 | 7,4 |
| E | 10 | 226,8 | 196,7 | 12,6 | 6,7 |
| E | 12 | 227,8 | 195,9 | 12,8 | 6,6 |
| E | 14 | 230,6 | 200,5 | 12,2 | 5,6 |
| E | 16 | 235,7 | 207,9 | 11,7 | 6,4 |

TABLE 9

| | Alloy 6–0.47 Mg + 0.41 Si | | | | |
|---|---|---|---|---|---|
| | Total Time [hrs] | Rm | Rp02 | AB | Au |
| A | 3 | 189,1 | 144,5 | 13,7 | 7,5 |
| A | 4 | 205,6 | 170,5 | 13,2 | 6,6 |
| A | 5 | 212,0 | 182,4 | 13,0 | 5,8 |
| A | 6 | 216,0 | 187,0 | 12,3 | 5,6 |
| A | 7 | 216,4 | 188,8 | 11,9 | 5,5 |
| B | 3,5 | 208,2 | 172,3 | 12,8 | 6,7 |
| B | 4 | 213,0 | 175,5 | 12,1 | 6,3 |
| B | 4,5 | 219,6 | 190,5 | 12,0 | 6,0 |
| B | 5 | 225,5 | 199,4 | 11,9 | 5,6 |
| B | 6 | 225,8 | 202,2 | 11,9 | 5,8 |
| C | 4 | 195,3 | 148,7 | 14,1 | 8,1 |
| C | 5 | 214,1 | 178,6 | 13,8 | 6,8 |
| C | 6 | 227,3 | 198,7 | 13,2 | 6,3 |
| C | 7 | 229,4 | 203,7 | 12,3 | 6,6 |
| C | 8 | 228,2 | 200,7 | 12,1 | 6,1 |
| D | 7 | 222,9 | 185,0 | 12,6 | 7,8 |
| D | 8,5 | 230,7 | 194,0 | 13,0 | 6,8 |
| D | 10 | 236,6 | 205,7 | 13,0 | 6,6 |
| D | 11,5 | 236,7 | 208,0 | 12,4 | 6,6 |
| D | 13 | 239,6 | 207,1 | 11,5 | 5,7 |
| E | 8 | 229,4 | 196,8 | 12,7 | 6,4 |
| E | 10 | 233,5 | 199,5 | 13,0 | 7,1 |
| E | 12 | 237,0 | 206,9 | 12,3 | 6,7 |
| E | 14 | 236,0 | 206,5 | 12,0 | 6,2 |
| E | 16 | 240,3 | 214,4 | 12,4 | 6,8 |

TABLE 10

| | Alloy 7–0.41 Mg + 0.47 Si | | | | |
|---|---|---|---|---|---|
| | Total Time [hrs] | Rm | Rp02 | AB | Au |
| A | 3 | 195,9 | 155,9 | 13,5 | 6,6 |
| A | 4 | 208,9 | 170,0 | 13,3 | 6,4 |
| A | 5 | 216,2 | 188,6 | 12,5 | 6,2 |
| A | 6 | 220,4 | 195,1 | 12,5 | 5,5 |
| A | 7 | 222,0 | 196,1 | 11,5 | 5,4 |
| B | 3,5 | 216,0 | 179,5 | 12,2 | 6,4 |
| B | 4 | 219,1 | 184,4 | 12,2 | 6,1 |
| B | 4,5 | 228,0 | 200,0 | 11,9 | 5,8 |
| B | 5 | 230,2 | 205,9 | 11,4 | 6,1 |
| B | 6 | 231,1 | 211,1 | 11,8 | 5,5 |
| C | 4 | 205,5 | 157,7 | 15,0 | 7,8 |
| C | 5 | 225,2 | 190,8 | 13,1 | 6,8 |
| C | 6 | 230,4 | 203,3 | 12,0 | 6,5 |
| C | 7 | 234,5 | 208,9 | 12,1 | 6,2 |
| C | 8 | 235,4 | 213,4 | 11,8 | 5,9 |
| D | 7 | 231,1 | 190,6 | 13,6 | 7,6 |
| D | 8,5 | 240,3 | 208,7 | 11,4 | 6,3 |
| D | 10 | 241,6 | 212,0 | 12,5 | 7,3 |
| D | 11,5 | 244,3 | 218,2 | 11,9 | 6,3 |
| D | 13 | 246,3 | 204,2 | 11,3 | 6,3 |
| E | 8 | 233,5 | 197,2 | 12,9 | 7,6 |
| E | 10 | 241,1 | 205,8 | 12,8 | 7,2 |
| E | 12 | 244,6 | 214,7 | 11,9 | 6,5 |
| E | 14 | 246,7 | 220,2 | 11,8 | 6,3 |
| E | 16 | 247,5 | 221,6 | 11,2 | 5,8 |

TABLE 11

| | Alloy 8–0.36 Mg + 0.51 Si | | | | |
|---|---|---|---|---|---|
| | Total Time [hrs] | Rm | Rp02 | AB | Au |
| A | 3 | 200,1 | 161,8 | 13,0 | 7,0 |
| A | 4 | 212,5 | 178,5 | 12,6 | 6,2 |
| A | 5 | 221,9 | 195,6 | 12,6 | 5,7 |
| A | 6 | 222,5 | 195,7 | 12,0 | 6,0 |
| A | 7 | 224,6 | 196,0 | 12,4 | 5,9 |
| B | 3,5 | 222,2 | 186,9 | 12,6 | 6,6 |
| B | 4 | 224,5 | 188,8 | 12,1 | 6,1 |
| B | 4,5 | 230,9 | 203,4 | 12,2 | 6,6 |
| B | 5 | 231,1 | 211,7 | 11,9 | 6,6 |
| B | 6 | 232,3 | 208,8 | 11,4 | 5,6 |
| C | 4 | 215,3 | 168,5 | 14,5 | 8,3 |
| C | 5 | 228,9 | 194,9 | 13,6 | 7,5 |
| C | 6 | 234,1 | 206,4 | 12,6 | 7,1 |
| C | 7 | 239,4 | 213,3 | 11,9 | 6,4 |
| C | 8 | 239,1 | 212,5 | 11,9 | 5,9 |
| D | 7 | 236,7 | 195,9 | 13,1 | 7,9 |
| D | 8,5 | 244,4 | 209,6 | 12,2 | 7,0 |
| D | 10 | 247,1 | 220,4 | 11,8 | 6,7 |
| D | 11,5 | 246,8 | 217,8 | 12,1 | 7,2 |
| D | 13 | 249,4 | 223,7 | 11,4 | 6,6 |
| E | 8 | 243,0 | 207,7 | 12,8 | 7,6 |
| E | 10 | 244,8 | 215,3 | 12,4 | 7,4 |
| E | 12 | 247,6 | 219,6 | 12,0 | 6,9 |
| E | 14 | 249,3 | 222,5 | 12,5 | 7,1 |
| E | 16 | 250,1 | 220,8 | 11,5 | 7,0 |

Based upon these results the following comments apply.

The ultimate tensile strength (UTS) of alloy no. 1 is slightly below 180 MPa after ageing with the A—cycle and 6 hours total time. With the dual rate ageing cycles the UTS values are higher, but still not more than 190 MPA after a 5 hours B—cycle, and 195 MPa after a 7 hours C—cycle. With the D—cycle the UTS values reaches 210 MPa but not before a total ageing time of 13 hours.

The ultimate tensile strength (UTS) of alloy no. 2 is slightly above 180 MPa after the A—cycle and 6 hours total time. The UTS values are 195 MPa after a 5 hours B—cycle, and 205 MPa after a 7 hours C—cycle. With the D—cycle the UTS values reaches approximately 210 MPa after 9 hours and 215 MPa after 12 hours.

Alloy no. 3 which is closest to the $Mg5Si_6$ line on the Mg rich side, shows the highest mechanical properties of alloys 1–4. After the A—cycle the UTS is 190 MPa after 6 hours total time. With a 5 hours B—cycle the UTS is close to 205 MPa, and slightly above 210 MPa after a 7 hours C—cycle. With the D—ageing cycle of 9 hours the UTS is close to 220 MPa.

Alloy no. 4 shows lower mechanical properties than alloys 2 and 3. After the A—cycle with 6 hours total time the UTS is not more than 175 MPa. With the D—ageing cycle of 10 hours the UTS is close to 210 MPa.

These results clearly demonstrate that the optimum composition for obtaining the best mechanical properties with the lowest sum of Mg and Si, is close to the $Mg_5Si_6$ line on the Mg rich side.

Another important aspect with the Mg/Si ratio is that a low ratio seem to give shorter ageing times to obtain the maximum strength.

Alloys 5–8 have a constant sum of Mg and Si that is higher than for alloys 1–4. As compared to the $Mg_5Si_6$ line, all alloys 5–8 are located on the Mg rich side of $Mg_5Si_6$.

Alloy no. 5 which is farthest away from the $Mg_5Si_6$ line shows the lowest mechanical properties of four different alloys 5–8. With the A—cycle alloy no. 5 has a UTS value of approximately 210 MPa after 6 hours total time. Alloy no. 8 has an UTS value of 220 MPa after the same cycle. With the C—cycle of 7 hours total time the UTS values for alloys 5 and 8 are 220 and 240 MPa, respectively. With the D—cycle of 9 hours the UTS values are approximately 225 and 245 MPa.

Again, this shows that the highest mechanical properties are obtained with alloys closest to the $Mg_5Si_6$ line. As for alloys 1–4, the benefits of the dual rate ageing cycles seem to be highest for alloys closest to the $Mg_5Si_6$ line.

The ageing times to maximum strength seem to be shorter for alloys 5–8 than for alloys 1–4. This is as expected because the ageing times are reduced with increased alloy content. Also, for alloys 5–8 the ageing times seem to be somewhat shorter for alloy 8 than for alloy 5.

The total elongation values seem to be almost independent of the ageing cycle. At peak strength the total elongation values, AB, are around 12%, even though the strength values are higher for the dual rate ageing cycles.

EXAMPLE 2

Example 2 shows the ultimate tensile strength of profiles from directly and overheated billets of a 6061 alloy. The directly heated billets were heated to the temperature shown in the table and extruded at extrusion speeds below the maximum speed before deterioration of the profile surface. The overheated billets were preheated in a gas fired furnace to a temperature above the solvus temperature for the alloy and then cooled down to a normal extrusion temperature shown in table 12. After extrusion the profiles were water cooled and aged by a standard ageing cycle to peak strength.

TABLE 12

Ultimate tensile strength (UTS) in different positions of profiles from directly heated and overheated billets of a AA6061 alloy.

| Preheating | Billet temperature ° C. | UTS (front) MPa | UTS (middle) MPa | UTS (rear) MPa |
|---|---|---|---|---|
| Dir. Heated | 470 | 287.7 | 292.6 | 293.3 |
| Dir. Heated | 472 | 295.3 | 293.9 | 296.0 |
| Dir. Heated | 471 | 300.8 | 309.1 | 301.5 |
| Dir. Heated | 470 | 310.5 | 318.1 | 315.3 |
| Dir. Heated | 482 | 324.3 | 312.6 | 313.3 |

TABLE 12-continued

Ultimate tensile strength (UTS) in different positions of profiles from directly heated and overheated billets of a AA6061 alloy.

| Preheating | Billet temperature ° C. | UTS (front) MPa | UTS (middle) MPa | UTS (rear) MPa |
|---|---|---|---|---|
| Dir. Heated | 476 | 327.1 | 334.0 | 331.9 |
| Dir. Heated | 476 | 325.7 | 325.0 | 319.5 |
| Dir. Heated | 475 | 320.2 | 319.0 | 318.8 |
| Dir. Heated | 476 | 316.0 | 306.4 | 316.0 |
| Dir. Heated | 485 | 329.1 | 329.8 | 317.4 |
| Dir. Heated | 501 | 334.7 | 324.3 | 331.2 |
| Dir. Heated | 499 | 332.6 | 327.8 | 322.9 |
| Dir. Heated | 500 | 327.8 | 329.8 | 318.8 |
| Dir. Heated | 505 | 322.9 | 322.2 | 318.1 |
| Dir. Heated | 502 | 325.7 | 329.1 | 334.7 |
| Dir. Heated | 506 | 336.0 | 323.6 | 311.2 |
| Dir. Heated | 500 | 329.1 | 293.9 | 345.0 |
| Dir. Heated | 502 | 331.2 | 332.6 | 335.3 |
| Dir. Heated | 496 | 318.8 | 347.8 | 294.6 |
| Average UTS and standard deviation for directly heated billets | | 320.8/13.1 | 319.6/14.5 | 317.6/13.9 |
| Overheated | 506 | 333.3 | 325.7 | 331.3 |
| Overheated | 495 | 334.0 | 331.9 | 335.3 |
| Overheated | 493 | 343.6 | 345.0 | 333.3 |
| Overheated | 495 | 343.6 | 338.8 | 333.3 |
| Overheated | 490 | 339.5 | 332.6 | 327.1 |
| Overheated | 499 | 346.4 | 332.6 | 331.2 |
| Overheated | 496 | 332.6 | 335.3 | 331.9 |
| Overheated | 495 | 330.5 | 331.2 | 322.9 |
| Overheated | 493 | 332.6 | 334.7 | 333.3 |
| Overheated | 494 | 331.2 | 334.0 | 328.4 |
| Overheated | 494 | 329.1 | 338.8 | 337.4 |
| Overheated | 459 | 345.7 | 337.4 | 344.3 |
| Overheated | 467 | 340.2 | 338.1 | 330.5 |
| Overheated | 462 | 344.3 | 342.9 | 331.9 |
| Overheated | 459 | 334.0 | 329.8 | 326.4 |
| Overheated | 461 | 331.9 | 326.4 | 324.3 |
| Average UTS and standard deviation for overheated billets | | 337/5.9 | 334.7/5.2 | 331.4/5.0 |

By utilising the overheating process the mechanical properties will generally be higher and also more consistent than without overheating. Also, with overheating the mechanical properties are practically independent of the billet temperature prior to extrusion. This makes the extrusion process more robust with respect to providing high and consistent mechanical properties, making it possible to operate at lower alloy compositions with lower safety margins down to the requirements for mechanical properties.

What is claimed is:

1. A process of treating an aluminium alloy comprising 0.5 to 2.5 percent by weight of an alloying mixture of magnesium and silicon, the molar ratio of Mg/Si being 0.70 to 1.25, optionally an additional amount of Si equal to about ⅓ by weight percent of any amount of Fe, Mn and Cr in the alloy, unavoidable impurities, and balance aluminum, the process comprising the steps of:

casting, cooling, homogenising, preheating and extruding the alloy; and then ageing the alloy with a dual step ageing operation to a final hold temperature of 160° C. to 220° C., the dual step ageing operation comprising a first stage in which the alloy is heated at a heating rate above 100° C./hour to a temperature of 100 to 170° C., and comprises a second stage in which the alloy is heated at a heating rate of 5 to 50° C./hour to the final hold temperature, the ageing operation being performed in a time of 3 to 24 hours.

2. A process according to claim 1, wherein the alloy contains 0.60 to 1.10 percent by weight of the alloying mixture of magnesium and silicon and has a tensile strength of 185 to 250 MPa after the ageing operation.

3. A process according to claim 2, wherein the alloy contains 0.70 to 0.90 percent by weight of the alloying mixture of magnesium and silicon and has a tensile strength of 215 to 250 MPa after the ageing operation.

4. A process according to claim 1, wherein the alloy contains 0.80 to 1.40 percent by weight of the alloying mixture of magnesium and silicon and has a tensile strength of 245 to 290 MPa after the ageing operation.

5. A process according to claim 4, wherein the alloy contains 0.85 to 1.15 percent by weight of the alloying mixture of magnesium and silicon and has a tensile strength of 245 to 270 MPa after the ageing operation.

6. A process according to claim 4, wherein the alloy contains 0.95 to 1.25 percent by weight of the alloying mixture of magnesium and silicon and has a tensile strength of 265 to 290 MPa after the ageing operation.

7. A process according to claim 1, wherein the alloy contains 1.10 to 1.80 percent by weight of the alloying mixture of magnesium and silicon and has a tensile strength of 285 to 330 MPa after the ageing operation.

8. A process according to claim 7, wherein the alloy contains 1.10 to 1.40 percent by weight of the alloying mixture of magnesium and silicon and has a tensile strength of 285 to 310 MPa after the ageing operation.

9. A process according to claim 7, wherein the alloy contains 1.20 to 1.55 percent by weight of the alloying mixture of magnesium and silicon and has a tensile strength of 305 to 330 MPa after the ageing operation.

10. A process according to claim 1, wherein the alloy contains 0.60 to 0.80 percent by weight of the alloying mixture of magnesium and silicon and has a tensile strength of 185 to 220 MPa after the ageing operation.

11. A process according to claim 1, wherein the molar ratio of Mg/Si is at least 0.70.

12. A process according to claim 1, wherein the molar ratio of Mg/Si is at most 1.25.

13. A process according to claim 1, wherein the final hold temperature is at least 165° C.

14. A process according to claim 1, wherein the final hold temperature is at most 205° C.

15. A process according to claim 1, wherein in the second stage the heating rate is at least 7° C./hour.

16. A process according to claim 1, wherein in the second stage the heating rate is at most 30° C./hour.

17. A process according to claim 1, wherein at the end of the first stage the temperature is between 130 and 160° C.

18. A process according to claim 1, wherein the ageing operation is performed in at least 5 hours.

19. A process according to claim 1, wherein the ageing operation is performed in at most 12 hours.

20. A process according to claim 1, wherein during the preheating before extrusion the alloy is heated to a temperature between 510 and 550° C., after which the alloy is cooled.

* * * * *